US009980538B2

(12) United States Patent
Burke et al.

(10) Patent No.: US 9,980,538 B2
(45) Date of Patent: May 29, 2018

(54) ECO LOOP CLOSURE FABRIC

(71) Applicant: LEAR CORPORATION, Southfield, MI (US)

(72) Inventors: David Burke, Palmyra, PA (US); Peter Nittmann, Raleigh, NC (US); William E. Bond, Williamstown, PA (US)

(73) Assignee: LEAR CORPORATION, Southfield, MI (US)

( * ) Notice: Subject to any disclaimer, the term of this patent is extended or adjusted under 35 U.S.C. 154(b) by 238 days.

(21) Appl. No.: 14/982,542

(22) Filed: Dec. 29, 2015

(65) Prior Publication Data

US 2017/0181505 A1 Jun. 29, 2017

(51) Int. Cl.
*A44B 18/00* (2006.01)

(52) U.S. Cl.
CPC ..... *A44B 18/0073* (2013.01); *A44B 18/0034* (2013.01); *A44B 18/0038* (2013.01)

(58) Field of Classification Search
CPC ..... A44B 18/0011; A44B 18/0034; A44B 18/0073; D10B 2501/0632; D10B 2401/041; D10B 2501/063; D02G 3/402; D03D 15/00; D03D 15/0027; D03D 27/02
See application file for complete search history.

(56) References Cited

U.S. PATENT DOCUMENTS 4,795,668 A * 1/1989 Krueger ..... B01D 39/1623 428/174
4,910,062 A * 3/1990 Zinke ..... A44B 18/0023 156/72
5,789,058 A 8/1998 Todd et al.
5,922,436 A 7/1999 Banfield et al.
6,705,132 B1 3/2004 Hajek
6,845,639 B1 1/2005 Hajek
6,855,220 B2 2/2005 Wildeman
8,263,204 B2 9/2012 Higashinaka et al.
8,549,714 B1 10/2013 Shepard et al.
8,790,475 B2 7/2014 Cheng
2006/0019572 A1* 1/2006 Lester, Jr. ..... A44B 18/0011 442/411
2012/0122365 A1* 5/2012 Erickson ..... B32B 5/026 442/312
2016/0185071 A1* 6/2016 Homoelle ..... B32B 5/0226 428/92

FOREIGN PATENT DOCUMENTS

DE 9215328 U1 4/1993
DE 102006028377 A1 10/2007
DE 102013102813 A1 9/2014

OTHER PUBLICATIONS

German Office Action dated Jul. 5, 2017 for German Appn. No. 10 2016 222 276.7, 7 pgs.

* cited by examiner

*Primary Examiner* — Jack W Lavinder
(74) *Attorney, Agent, or Firm* — Brooks Kushman P.C.

(57) ABSTRACT

A knitted textile fabric includes a first knitted fabric layer including a first set of yarns. The first knitted fabric layer has outwardly extending pile underlap loops at one face adapted for mated engagement with hooking elements of a hook component of a hook-and-loop fastener. The knitted textile fabric also includes a second knitted fabric layer having a second set of yarns attached to the first knitted fabric layer. The second set of yarns includes a plurality of filaments in which adjacent filaments are fused together and adjacent yarns are fused together.

20 Claims, 4 Drawing Sheets

ECO LOOP CLOSURE FABRIC

TECHNICAL FIELD

In at least one aspect, the present invention relates to knitted fabrics, and in particular, knitted fabrics for use in hook-and-loop fasteners.

BACKGROUND

"Hook-and-loop" fasteners are used in diverse applications such as automotive trim. These fasteners typically include two generally flat components attachable and detachable to and from face abutting relation with one another. The loop or "female" fastener component is of a textile fabric construction, generally having a fabric ground layer with a plurality of relatively flexible pile-type loops extending outwardly from one face of the ground layer. The hook or "male" component may be of an extruded or molded plastic construction having any of various forms of relatively stiff, molded or extruded hook-shaped elements extending in upstanding relation from one face of a ground layer, or may also be of a textile fabric construction similarly having a fabric ground layer with a plurality of hook-shaped elements upstanding from one face of the ground layer. In use, the hook and loop faces of the fastener components grippingly engage one another when pressed together in face abutting relation by penetration of the hook-shaped elements of the hook component into the loops at the opposing face of the loop component. The engagement between the hook and loop faces of the two components resists separation thereof until a threshold force is exerted on one component in a peeling-like fashion.

In many applications, stiff backing layers are desired. For instance, in hook-and-loop" fasteners, the loop component includes a knitted layer having a series of protruding loops attached to a backing layer. The current practice to stiffen a backing layer involves the application of a coating that includes a number of precursor chemicals. Examples of such coatings include acrylic coatings, urethane coatings, and the like. Moreover, these coatings can include a variety of undesirable chemicals such as formaldehyde. While this prior art technique is effective, it creates a number of secondary issues. For example, coatings often result in a diminished fastening efficacy in hook-and-loop fasteners. The application of chemicals is difficult to control, not always uniform, and can lead to expensive waste stream management. From an environmental standpoint, alternative designs that do not use formaldehyde may be advantageous.

Accordingly, there is a need for improved fabrics used in hook-and-loop fasteners.

SUMMARY OF THE INVENTION

The present invention solves one or more problems of the prior art by providing in at least one embodiment a knitted textile fabric having increased stiffness. The knitted textile fabric includes a first knitted fabric layer including a first set of yarns. The first knitted fabric layer has outwardly extending pile underlap loops at one face adapted for mated engagement with hooking elements of a hook component of a hook-and-loop fastener. The knitted textile fabric also includes a second knitted fabric layer having a second set of yarns attached to the first knitted fabric layer. Characteristically, adjacent filaments are fused together and adjacent yarns in the second knitted fabric layer are fused together.

Advantageously, the knitted fabric can be used as the loop component in a hook-and-loop fastener.

In another embodiment, a knitted textile fabric having increased stiffness is provided. The knitted textile fabric includes a first knitted fabric layer including a first set of yarns. The first knitted fabric layer has outwardly extending pile underlap loops at one face adapted for mated engagement with hooking elements of a hook component of a hook-and-loop fastener. The knitted textile fabric also includes a second knitted fabric layer having a second set of yarns attached to the first knitted layer. The second set of yarns including a plurality of filaments in which each filament includes a core region having a first melting point and a sheath region having a second melting point where the second melting point is lower than the first melting point. Characteristically, sheath regions of adjacent filaments are fused together and adjacent yarns in the second knitted fabric layer are fused together. Advantageously, the knitted fabric can be used as the loop component in a hook-and-loop fastener In another refinement, a hook-and-loop fastener incorporating the knitted textile fabrics set forth above is provided. The hook-and-loop fastener includes a hook component having hooking elements, a first knitted fabric layer including a first set of yarns, and a second knitted fabric layer including a second set of yarns. The first knitted fabric layer includes outwardly extending pile underlap loops at one face which are adapted for mated engagement with the hooking elements. The second knitted fabric layer is attached to the first knitted fabric. Characteristically, sheath regions of adjacent filaments are fused together and adjacent yarns in the second knitted fabric layer are fused together.

In another embodiment, a method of making the knitted textile fabrics set forth above is provided. The method includes a step of forming a bilayer structure by placing the first knitted fabric layer over the second knitted fabric layer. A front surface of the first knitted fabric layer is heated to a first temperature while a back surface of the second knitted fabric layer is heated to a second temperature. Characteristically, the second temperature is higher than the first temperature.

Embodiments of the invention provide a number of advantages over the prior art. In particular, the method allows the preparation of a firm stiff backing without the introduction of undesirable chemicals such as formaldehyde. This is in contrast to the current practice in which a coating is applied to stiffen many materials. In the present invention, co-polymers can be used to provide uniform bonding thereby eliminating the need for a secondary finish.

BRIEF DESCRIPTION OF THE DRAWINGS

Exemplary embodiments of the present invention will become more fully understood from the detailed description and the accompanying drawings, wherein.

DETAILED DESCRIPTION OF THE PREFERRED EMBODIMENT(S)

Figure 1:
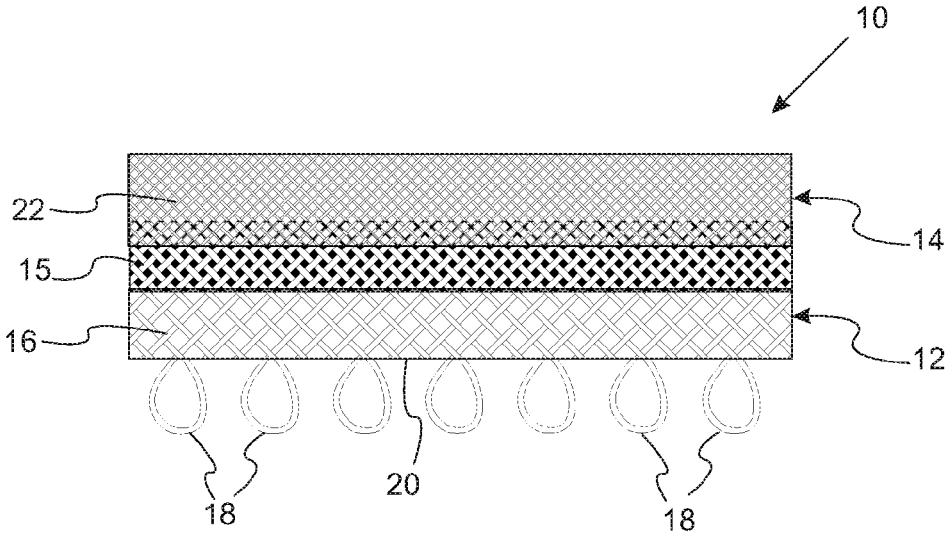
FIG. 1 is a schematic cross section of a knitted textile fabric having a layer with protruding loops and a backing layer having fused fibers.

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the term "polymer" includes "oligomer," "copolymer," "terpolymer," "block", "random," "segmented block," and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "denier" refers to a weight-per-unit-length measure of a linear material such as a yarn, fiber, or filament. Officially, it is the number of unit weights of 0.05 grams per 450-meter length. Typically, the denier is reported as weight in grams of 9,000 meters of the linear material.

The term "denier per filament" (dpf) is the denier of an individual continuous filament or an individual fiber if it were continuous. For filament yarns, the dpf is the yarn denier divided by the number of filaments.

The term "fiber" refers to a single filament of natural material (e.g., cotton, linen or wool) or of an artificial material (e.g., nylon, polyester).

The term "yarn" refers to a spun agglomeration of fibers used for knitting, weaving or sewing.

Figure 2:
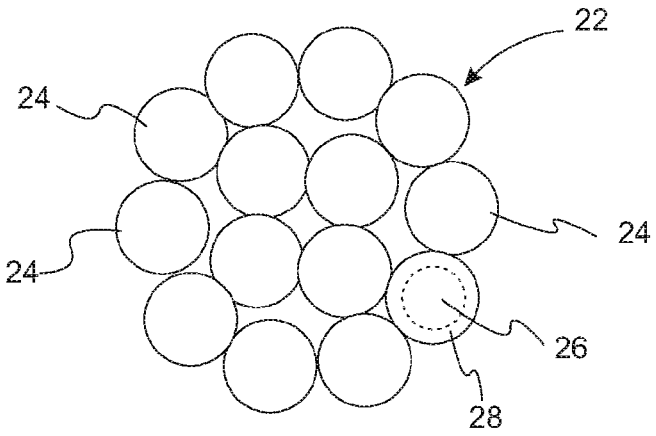
FIG. 2 is a cross section of the yarn in the backing layer of FIG. 1.

With reference to FIGS. 1 and 2, a knitted textile fabric for use as the loop component in a hook-and-loop fastener is depicted. FIG. 1 is a schematic cross section of the knitted fabric. Knitted textile fabric 10 includes a first knitted fabric layer 12 and a second knitted fabric layer 14 that are attached together. In some variations, this attached is achieved at least in part by inter-looping between first knitted fabric layer 12 and a second knitted fabric layer 14 during the multi-bar knitting process. In a refinement, knitted textile fabric 10 includes one or more additional layers 15 interposed between first knitted fabric layer 12 and a second knitted fabric layer 14. In another refinement, first knitted fabric layer 12 and second knitted fabric layer 14 are each independently, a warp knitted textile fabric or a weft knitted textile fabric. In particular, warp knitted textile fabrics are found to be particularly useful. The first knitted fabric layer 12 includes a first set of yarns 16. The first knitted fabric layer 12 also includes outwardly extending pile underlap loops 18 at first face 20 which are adapted for mated engagement with hooking elements of a hook component of a hook-and-loop fastener. The second knitted fabric layer 14 includes a second set of yarns 22. In some variations, knitted textile fabric 10 is an unbroken loop construction (i.e., a 2 bar knit). In other variations, knitted textile fabric 10 is a multiple loop construction (i.e., a 3 or more bar knit). Examples of these constructions can be found in U.S. Pat. Nos. 6,845,639; 6,705,132; and 6,705,132; the entire disclosures of which are incorporated by reference.

FIG. 2 is a cross section of the yarn of the second set of yarns. Characteristically, adjacent filaments are bonded together and adjacent yarns of the second knitted fabric layer 14 are bonded together. Advantageously, the bonding between adjacent filaments and adjacent yarns is accomplished by melting and subsequent fusion of the filaments. In a variation, the yarn in the second set of yarns 22 includes a plurality of filaments 24 in which each filament includes a first component 26 and a second component 28. The first component 26 has a first melting point and the second component 28 has a second melting point where the second melting point is lower than the first melting point. Sheath regions of adjacent filaments are bonded together and adjacent yarns of the second knitted fabric layer 14 are bonded together. In this variation, the bonding between adjacent filaments and adjacent yarns is accomplished by melting and subsequent fusion of the sheath regions. Similarly, the first knitted fabric layer 12 and the second knitted fabric layer 14 can be fused together during the melting process.

Figure 3A:
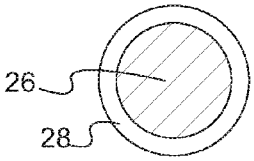
FIG. 3A provides a cross section of a yarn filament having a core region and sheath region arranged concentrically.
Figure 3B:
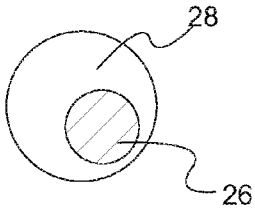
FIG. 3B provides a cross section of a yarn filament with a core region and a sheath region arranged eccentrically.
Figure 3C:
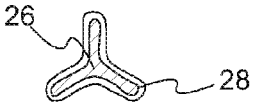
FIG. 3C provides a cross section of a trilobal arrangement for the core and sheath regions.
Figure 3D:
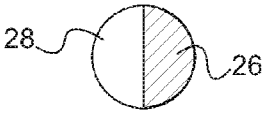
FIG. 3D provides a cross section illustrating a filament configuration with a higher melting component and a lower melting component arranged in a side-by-side configuration.
Figure 3E:
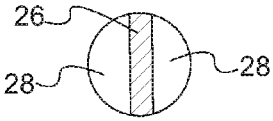
FIG. 3E provides a cross section of a filament arrangement with a stripe of a higher melting component within a lower melting component.
Figure 3F:
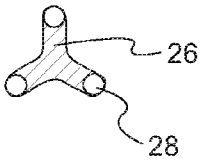
FIG. 3F provides a cross section of a filament arrangement with lower melting component located at the tips of a trilobal configuration.
Figure 3G:
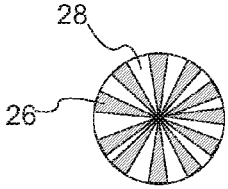
FIG. 3G provides a cross section illustrating a segmented pie arrangement of a higher melting component and a lower melting component.
Figure 3H:
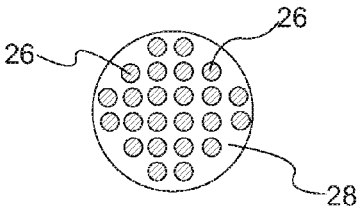
FIG. 3H provides a cross section illustrating islands of the higher melting component dispersed in a lower melting component.
Figure 3I:
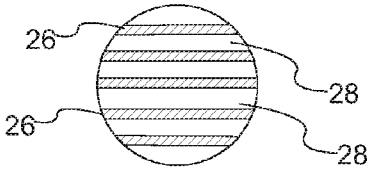
FIG. 3I shows an arrangement with strips of a higher melting component and lower melting component.

FIGS. 3A-I provide cross sections of various two component yarn filaments. For example, FIG. 3A-C shows yarn filaments in which first component 26 is a core region and second component 28 is a sheath region. In FIG. 3A, the yarn filaments are arranged with the core region and sheath region arranged concentrically. In FIG. 3B, the core region and a sheath region are arranged eccentrically. FIG. 3C provides a cross section of a multilobal (e.g., trilobal) arrangement for the core and sheath regions. FIGS. 3D-E provide examples of side-by-side arrangements of first component 26 and second component 28. FIG. 3D illustrates a filament configuration with first component 26 and second component occupying adjacent regions. FIG. 3E shows a filament arrangement with a stripe of first component 26. FIG. 3F show an arrangement with second component 28 located at the tips of a trilobal configuration. FIGS. 3G-H provides examples of micro-denier arrangements of filaments. FIG. 3G illustrates a segmented pie arrangement of first component 26 and second component 28. FIG. 3H illustrates islands of first component 26 dispersed in a sea of second component 28. Finally, FIG. 3I shows an arrangement with strips of first component 26 and second component 28.

With reference to FIGS. 1, 2, and 3A-I, the first set of yarns 16 and second set of yarns 22 are not limited to any particular type of yarns. Artificial polymeric or resinous yarns are found to be particularly useful. In a refinement, the first set of yarns 16 and the second set of yarns each independently include nylon (i.e., polyamides) yarns and/or polyester yarns. In a further refinement, the second set of yarns includes polyester yarns. In certain variations as set forth above, the filaments in the yarns of the second set of yarns 22 include a core region and a sheath region. In a refinement, the core region is formed from polyamide or polyester while the sheath region is formed from co-polyester or co-polyamides. In another refinement, the core region is from about 50 to 90 weight percent of the total weight of a filament. In another refinement, the sheath region is from about 50 to 10 weight percent of the total weight of a filament. In still another refinement, the core region is from about 60 to 80 weight percent of the total weight of a filament and the sheath region is from about 40 to 20 weight percent of the total weight of a filament.

It should also be appreciated that the first set of yarns 16 and second set of yarns 22 are not limited to any particular weight density and denier. In a variation, yarns 16 and yarns 22 independently have a weight density of 1.0 oz/yd$^2$ to 14 oz/yd$^2$. The yarns 16 and yarns 22 are also characterized by the denier of the yarns. In the refinement, yarns 16 and yarns 22 independently have a dpf from about 1.25 to 3.75. In another refinement, yarns 16 and yarns 22 independently have a dpf of about 2.08 or 2.92. As set forth above, the second set of yarns 22 is also characterized by the melting points of the core regions and sheath regions of the constituent filaments. In a refinement, core region 26 has a melting point greater than or equal to about 250° C. and sheath region 28 has a melting point less than or equal to about 225° C. In another refinement, core region 26 has a melting point from 250° C. to 350° C. In still another refinement, core region 26 has a melting point from 250° C. to 300° C. In a further refinement, sheath region 28 has a melting point from about 150° C. to 225° C. In a further refinement, sheath region 28 has a melting point from about 150° C. to 220° C. In another refinement, sheath region 28 has a melting point from about 180° C. to 190° C.

Figure 4:
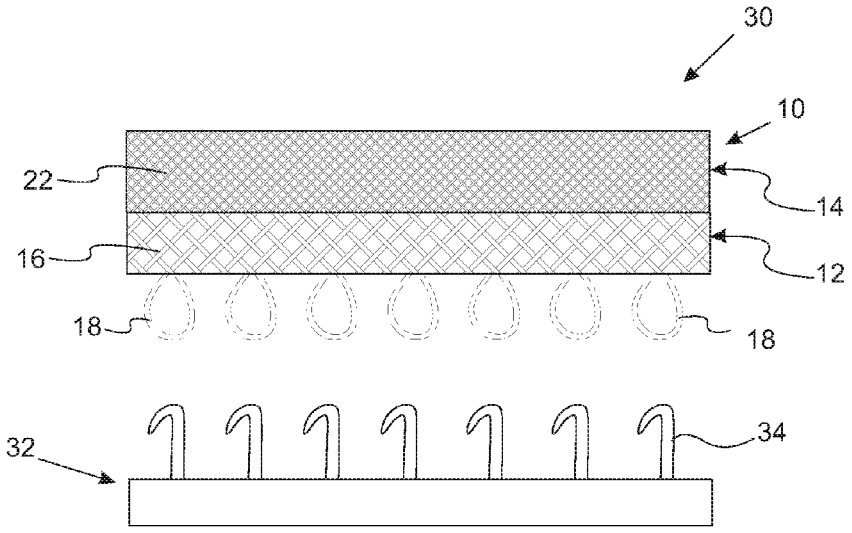
FIG. 4 is a schematic cross section of a hook-and-loop fastener incorporating the knitted textile fabric of FIG. 1.

With reference to FIG. 4, a schematic illustration of a hoop-and-loop fastener integrating the knitted textile fabric of FIG. 1 is provided. Hook-and-loop fastener 30 includes a hook component 32 having hooking elements 34 and knitted textile fabric 10 set forth above. In this embodiment, knitted textile fabric 10 functions as the loop component. Hooking elements attached to loops 18 extending from first knitted fabric layer 12 by penetration of the hook-shaped elements of the hook component 32 into the loops 18 at the opposing face of the loop component.

Figure 5:
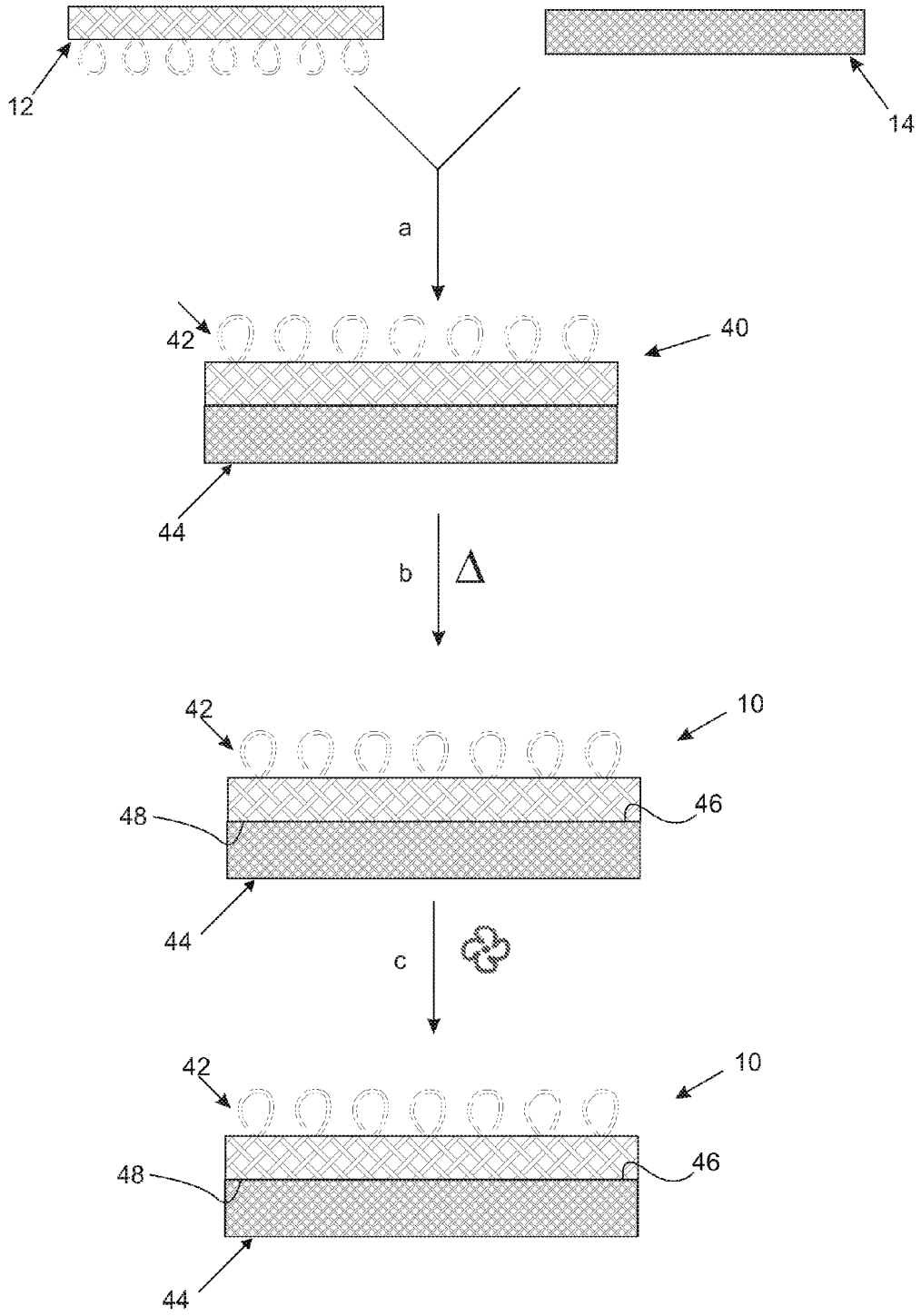
FIG. 5 is a schematic flowchart illustrating a method for making the knitted fabric of FIG. 1.

With reference to FIG. 5, a method of making the knitted textile fabric set forth above is provided. In step a), bilayer structure 40 is formed by placing the first knitted fabric layer 12 over the second knitted fabric layer 14. In a variation, the bilayer structure 40 is formed during a multibar (e.g., two bar) knitting process. In step b), a front face 42 of the first knitted fabric layer 12 is heated to a first temperature while a back face 44 of the second knitted fabric layer is heated to a second temperature to form knitted textile fabric 10. Face 46 of first knitted fabric layer 12 contacts face 48 of second knitted fabric layer 14. The second temperature is higher than the first temperature. The second temperature is sufficiently high to melt yarns 22 so that adjacent filaments fusion together when cooled. The heating of this step can also allow fusion of the first knitted fabric layer 12 to second knitted fabric layer 14.

In the variation where the filaments in the yarns of the second set of yarns 22 include a core region and a sheath region, the second temperature is sufficiently high to melt the sheath regions of yarns 22 so that adjacent filaments fusion together when cooled. Therefore, the second temperature is higher than or equal to the melting point of the sheath regions (i.e., second melting temperature set forth above). In a further refinement, the second temperature is higher than or equal to the melting point of the core regions (i.e., first melting temperature set forth above). In a refinement, the first temperature is lower than the melting point of the sheath regions. In a refinement, the first temperature is from about 130° C. to about 170° C. while the second temperature is from about 175° C. to about 210° C. In step c), the formed knitted textile fabric 10 is cooled or allowed to cool to room temperature (about 25° C.).

Figure 6:
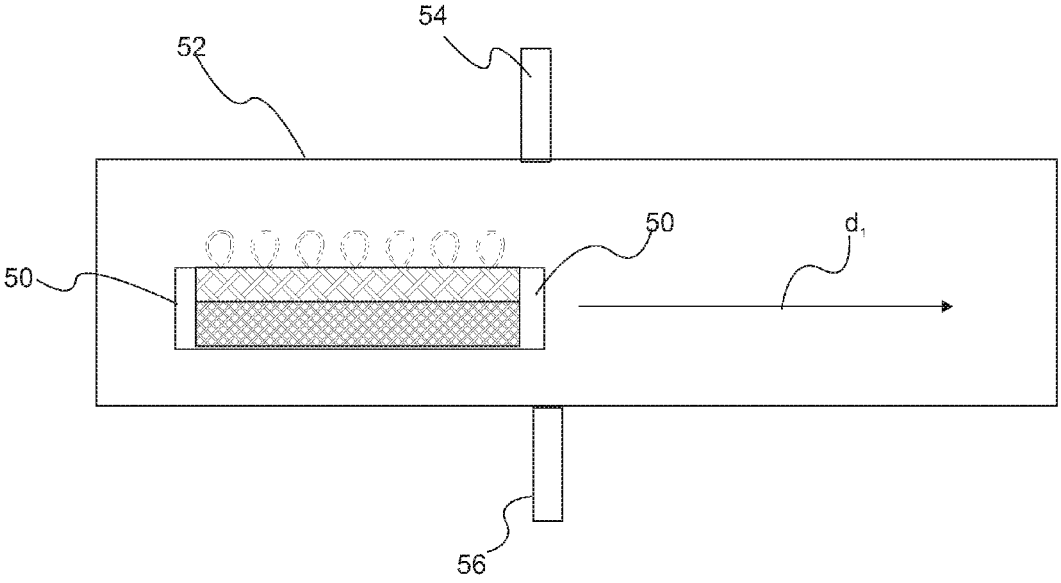
FIG. 6 is a schematic cross section illustrating the heating of a bilayer structure depicted in FIG. 5.

With reference to FIG. 6, a schematic cross section illustrating the heating of bilayer structure 40 in step b) of FIG. 4 is provided. Bilayer structure 40 is held taunt by tenter 50 and conveyed through furnace 52 along direction $d_1$. The temperature at front face 42 is controlled by the air flow from inlet 54 while the temperature of back face 44 of the second knitted fabric layer is controlled by the air flow from inlet 56.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A knitted textile fabric comprising:

a first knitted fabric layer including a first set of yarns, the first knitted fabric layer having outwardly extending pile underlap loops at one face adapted for mated engagement with hooking elements of a hook component of a hook-and-loop fastener; and a second knitted fabric layer including a second set of yarns, the second set of yarns including a plurality of filaments, wherein the second knitted fabric layer is fused to the first knitted fabric layer and adjacent filaments are fused together and adjacent yarns are bonded together.

2. The knitted textile fabric of claim 1 wherein each filament includes a first component having a first melting point and a second component having a second melting point wherein the second melting point is lower than the first melting point.

3. The knitted textile fabric of claim 2 wherein the first component and second component are arranged side-by-side.

4. The knitted textile fabric of claim 2 wherein the first component and second component are arranged with islands of the first component dispersed within the second component.

5. The knitted textile fabric of claim 2 wherein the first component and second component are arranged with a core region of the first component and a sheath region of the second component.

6. The knitted textile fabric of claim 5 wherein the core region is from about 50 to 90 weight percent of the total weight of a filament and the sheath region is from about 50 to 10 weight percent of the total weight of a filament.

7. The knitted textile fabric of claim 5 wherein the core region has a melting point greater than about 250° C. and the sheath region has a melting point less than about 225° C.

8. The knitted textile fabric of claim 1 wherein the first knitted fabric layer and the second knitted fabric layer are each independently a warp knitted fabric layer.

9. The knitted textile fabric of claim 1 wherein the first set of yarns includes a component selected from the group consisting of polyester yarns and polyamide yarns.

10. The knitted textile fabric of claim 1 wherein the first set of yarns includes polyamide yarns and the second set of yarns includes polyester yarns.

11. A hook-and-loop fastener comprising:

a hook component having hooking elements;

a first knitted fabric layer including a first set of yarns, the first knitted fabric layer having outwardly extending pile underlap loops at one face adapted for mated engagement with the hooking elements; and a second knitted fabric layer including a second set of yarns, the second knitted fabric layer being attached to the first knitted fabric layer, wherein adjacent filaments are fused together and adjacent yarns are fused together.

12. The hook-and-loop fastener of claim 11 wherein each filament includes a first component having a first melting point and a second component having a second melting point wherein the second melting point is lower than the first melting point.

13. The hook-and-loop fastener of claim 12 wherein the first component and second component are arranged side-by-side.

14. The hook-and-loop fastener of claim 12 wherein the first component and second component are arranged with islands of the first component dispersed within the second component.

15. The hook-and-loop fastener of claim 12 wherein the first component and second component are arranged with a core region of the first component and a sheath region of the second component.

16. The hook-and-loop fastener of claim 15 wherein the core region is from about 50 to 90 weight percent of the total weight of a filament and the sheath region is from about 50 to 10 weight percent of the total weight of a filament.

17. The hook-and-loop fastener of claim 11 wherein the first knitted fabric layer and the second knitted fabric layer are each independently a warp knitted fabric layer.

18. The hook-and-loop fastener of claim 11 wherein the first set of yarns includes a component selected from the group consisting of polyester yarns and nylon yarns and the second set of yarns includes polyester yarns.

19. A method of making a knitted textile fabric which includes:

a first knitted fabric layer including a first set of yarns, the first knitted fabric layer having outwardly extending pile underlap loops at one face adapted for mated engagement with hooking elements of a hook component of a hook-and-loop fastener; and a second knitted fabric layer including a second set of yarns, the second set of yarns including a plurality of filaments, wherein adjacent filaments are bonded together and adjacent yarns are bonded together, the method comprising:

forming a bilayer structure by placing the first knitted fabric layer over the second knitted fabric layer; and heating a front surface of the first knitted fabric layer to a first temperature and a back surface of the second knitted fabric layer to a second temperature, the second temperature being higher than the first temperature.

20. The method of claim 19 wherein each filament includes a first component having a first melting point and a second component having a second melting point wherein the second melting point is lower than the first melting point.

* * * * *